US007460794B2

(12) United States Patent
Shin

(10) Patent No.: US 7,460,794 B2
(45) Date of Patent: Dec. 2, 2008

(54) IMAGE FORMING APPARATUS AND METHOD

(75) Inventor: Dong-myong Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 71 days.

(21) Appl. No.: 11/311,369

(22) Filed: Dec. 20, 2005

(65) Prior Publication Data

US 2006/0133830 A1 Jun. 22, 2006

(30) Foreign Application Priority Data

Dec. 20, 2004 (KR) ..... 10-2004-0108811

(51) Int. Cl.
*G03G 15/00* (2006.01)
*G03G 21/02* (2006.01)

(52) U.S. Cl. ..... 399/8; 399/24; 399/79

(58) Field of Classification Search ..... 399/8, 399/24, 27, 79
See application file for complete search history.

(56) References Cited

U.S. PATENT DOCUMENTS

| | | | | |
|---|---|---|---|---|
| 6,275,664 | B1 * | 8/2001 | Wolf et al. | 399/8 |
| 6,490,422 | B2 * | 12/2002 | Harumoto | 399/27 |
| 6,658,219 | B1 * | 12/2003 | Ito et al. | 399/27 |
| 6,748,183 | B2 * | 6/2004 | Edmonds | 399/24 X |
| 6,965,441 | B1 * | 11/2005 | Haines et al. | 399/24 X |
| 7,085,503 | B2 * | 8/2006 | Mokuya | 399/8 |
| 2003/0090696 | A1 | 5/2003 | Willis et al. | |
| 2004/0080783 | A1 | 4/2004 | Owen et al. | |

FOREIGN PATENT DOCUMENTS

| | | |
|---|---|---|
| JP | 59-061854 | 4/1984 |
| JP | 04-285983 | 10/1992 |
| JP | 08-339136 | 12/1996 |
| JP | 2001-092620 | 4/2001 |
| JP | 2002-304268 | 10/2002 |
| JP | 2003-216395 | 7/2003 |
| JP | 2003-223523 | 8/2003 |
| KR | 2000-0066083 | 11/2000 |
| KR | 2004-0018869 | 3/2004 |

* cited by examiner

*Primary Examiner*—Sandra L Brase
(74) *Attorney, Agent, or Firm*—Roylance, Abrams, Berdo & Goodman LLP

(57) ABSTRACT

An image forming apparatus and method where a first terminal group comprises one or more host terminals, a second terminal group is connected to the first terminal group via a network and comprises one or more host terminals, and an image forming apparatus is connected to the first and second terminal groups via the network, and forms an image using a predetermined expendable material in response to a drive command issued by one of the host terminals belonging to the first or second terminal group. An expendable element has a memory that stores information regarding a remaining amount of expendable material for each of the first and second terminal groups. Accordingly, it is possible for host terminals to obtain the benefits of being connected to a plurality of image forming apparatuses from a single image forming apparatus.

17 Claims, 3 Drawing Sheets

IMAGE FORMING APPARATUS AND METHOD

CROSS-REFERENCE TO RELATED PATENT APPLICATION

This application claims the benefit under 35 U.S.C. §119 from Korean Patent Application No. 10-2004-0108811, filed on Dec. 20, 2004, in the Korean Intellectual Property Office, the entire disclosure of which is hereby incorporated by reference.

BACKGROUND OF THE INVENTION

1. Field of the Invention

The present invention relates to an image forming apparatus, such as a laser printer. More particularly, the present invention relates to an image forming apparatus and method, which allow a plurality of host terminals that control the image forming apparatus to share and use the image forming apparatus and to still obtain the benefits of being connected to a plurality of image forming apparatuses by dividing customer replacement unit monitor (CRUM) information which is stored in the image forming apparatus for each of a plurality of terminal groups into which the host terminals are classified.

2. Description of the Related Art

In general, image forming apparatuses, such as copying machines, printers, facsimiles, or multifunctional devices into which a copying machine, a printer, and facsimile are integrated, support a printing function. Image forming apparatuses form images by interfacing with a host computer to which they are connected. In addition, image forming apparatuses form images by consuming an expendable element, which is installed therein and is replaceable.

An image forming apparatus may be controlled by a plurality of host terminals connected to a network. The host terminals may include a user terminal used by a user and a manager terminal used by a manager managing the user.

Conventionally, if an image forming apparatus uses up an expendable material contained in an expendable element, it cannot be used until the expendable element is replaced with a new one. This problem becomes apparent when there is a manager who wants to use an image forming apparatus for urgent matters.

SUMMARY OF THE INVENTION

The present invention provides an image forming apparatus and method, which allow a plurality of host terminals that control the image forming apparatus to share and use the image forming apparatus while obtaining the benefits of being connected to a plurality of image forming apparatuses by storing customer replacement unit monitor (CRUM) information for each of a plurality of terminal groups into which the host terminals are classified.

According to an aspect of the present invention, there is provided a printing device. The printing device comprises a first terminal group comprising one or more host terminals, a second terminal group which is connected to the first terminal group via a network and comprises one or more host terminals, and an image forming apparatus which is connected to the first and second terminal groups via the network, forms an image using a predetermined expendable material in response to a drive command issued by one of the host terminals belonging to the first or second terminal group, and includes an expendable element having a memory that stores information regarding a remaining amount of expendable material for each of the first and second terminal groups.

The image forming apparatus may comprise a memory which stores the information on the remaining amount of expendable material for each of the first and second terminal groups, a control unit which reads information corresponding to one of the first and second terminal groups that the host terminal that has issued the drive command belongs to from the memory in response to the drive command and generates a control signal if the read information specifies the amount of expendable material required for forming an image, and a function execution unit which forms the image by performing an operation in response to the control signal. When the function execution unit performs its operation, the information regarding the remaining amount of expendable material stored in the memory may be updated.

The memory may store information regarding an accumulated number of times that the image forming apparatus has been driven and a number of times that the image forming apparatus can be driven for each of the first and second terminal groups, and the image forming apparatus may be connected to the first and second terminal groups via the network and forms an image in response to the drive command.

The memory may store information regarding an accumulated number of times that the image forming apparatus has been driven and a number of times that the image forming apparatus can be driven for each of the first and second terminal groups, and the control unit may generate a control signal if the number of times that the image forming apparatus can be driven for the terminal group to which the host terminal that has issued the drive command belongs is greater than the accumulated number of times that the image forming apparatus has been driven, and increase the accumulated number of times that the image forming apparatus has been driven after the function execution unit performs its operation.

According to another aspect of the present invention, there is provided an image forming apparatus which is connected to a network together with one or more host terminals and forms an image under the control of one of the host terminals by consuming a predetermined expendable material. The image forming apparatus comprises a memory which stores information regarding a remaining amount of expendable material for each of the host terminals, a control unit which reads information corresponding to the host terminal that has issued a drive command from the memory in response to the drive command and generates a control signal if the read information specifies the amount of expendable material required for forming an image, and a function execution unit which forms the image by performing an operation in response to the control signal. When the function execution unit performs its operation, the information regarding the remaining amount of expendable material stored in the memory may be updated.

The host terminals may be classified into a plurality of terminal groups, the memory may store the information regarding the remaining amount of expendable material for each of the terminal groups, and the control unit may read information corresponding to the terminal group to which the host terminal that has issued the drive command belongs from the memory and generate a control signal if the read information specifies the amount of expendable material required for forming an image.

The memory may store information regarding an accumulated number of times that the image forming apparatus has been driven and a number of times that the image forming apparatus can be driven for each of the first and second terminal groups, and the control unit may generate a control signal if the number of times that the image forming apparatus can be driven for the terminal group to which the host terminal that has issued the drive command belongs is greater than the accumulated number of times that the image forming apparatus has been driven, and increases the accumulated number of times that the image forming apparatus has been driven after the function execution unit performs its operation.

The memory may be included in an expendable element which is installed in the image forming apparatus and is replaceable.

The memory may store the information regarding the number of times that the image forming apparatus can be driven before the image forming apparatus uses the expendable material for the first time.

The image forming apparatus may be a laser printer, and the expendable element may be a toner cartridge.

According to another aspect of the present invention, there is provided an image forming method of driving an image forming apparatus in response to a drive command issued by one of a plurality of host terminals connected to a network to form an image using a predetermined expendable material. The image forming method comprises determining which of the host terminals issued the drive command, reading expendable material information corresponding to the host terminal that is determined to have issued the drive command from stored expendable material information corresponding to the respective host terminals, and forming an image by driving the image forming apparatus in response to the drive command if the read expendable material information indicates that the amount of expendable material required for forming the image is less than a remaining amount of expendable material. The expendable material information is information regarding a remaining amount of expendable material.

The determining of which of the host terminals has issued the drive command may include determining which of a plurality of terminal groups the host terminal that has issued the drive command belongs to, and the reading of the expendable material information may include reading expendable material information corresponding to the terminal group to which the host terminal that has issued the drive command belongs from stored expendable material information corresponding to the respective terminal groups.

The image forming method may also include storing the expendable material information before the determining of which one of the host terminals has issued the drive command.

The image forming may also include updating the expendable material information after forming the image.

The image forming method may also comprise forming an image by driving the image forming apparatus in response to the drive command if the read expendable material information indicates that the amount of expendable material required for forming the image is equal to the remaining amount of expendable material.

The image forming method may also comprise displaying a message indicating that an expendable element of the image forming apparatus needs to be replaced if the amount of expendable material required for forming the image is larger than the remaining amount of expendable material.

According to another aspect of the present invention, there is provided a computer-readable recording medium storing a computer program for executing an image forming method of driving an image forming apparatus in response to a drive command issued by one of a plurality of host terminals connected to a network to form an image using a predetermined expendable material. The image forming method comprises determining which of the host terminals issued the drive command, reading expendable material information corresponding to the host terminal that is determined to have issued the drive command from stored expendable material information corresponding to the respective host terminals, and forming an image by driving the image forming apparatus in response to the drive command if the read expendable material information indicates that the amount of expendable material required for forming the image is less than a remaining amount of expendable material. The expendable material information is information regarding a remaining amount of expendable material.

BRIEF DESCRIPTION OF THE DRAWINGS

The above and other features and advantages of the present invention will become more apparent by describing in detail exemplary embodiments thereof with reference to the attached drawings in which like reference symbols indicate the same or similar components, wherein.

DETAILED DESCRIPTION OF THE INVENTION

The present invention will now be described more fully with reference to the accompanying drawings in which exemplary embodiments of the invention are shown. Terms used in this disclosure have been defined in consideration of their functions in this disclosure and may have different meanings depending on a user's intent or understanding. Therefore, the terms are defined based on the invention claimed in this disclosure.

Figure 1:
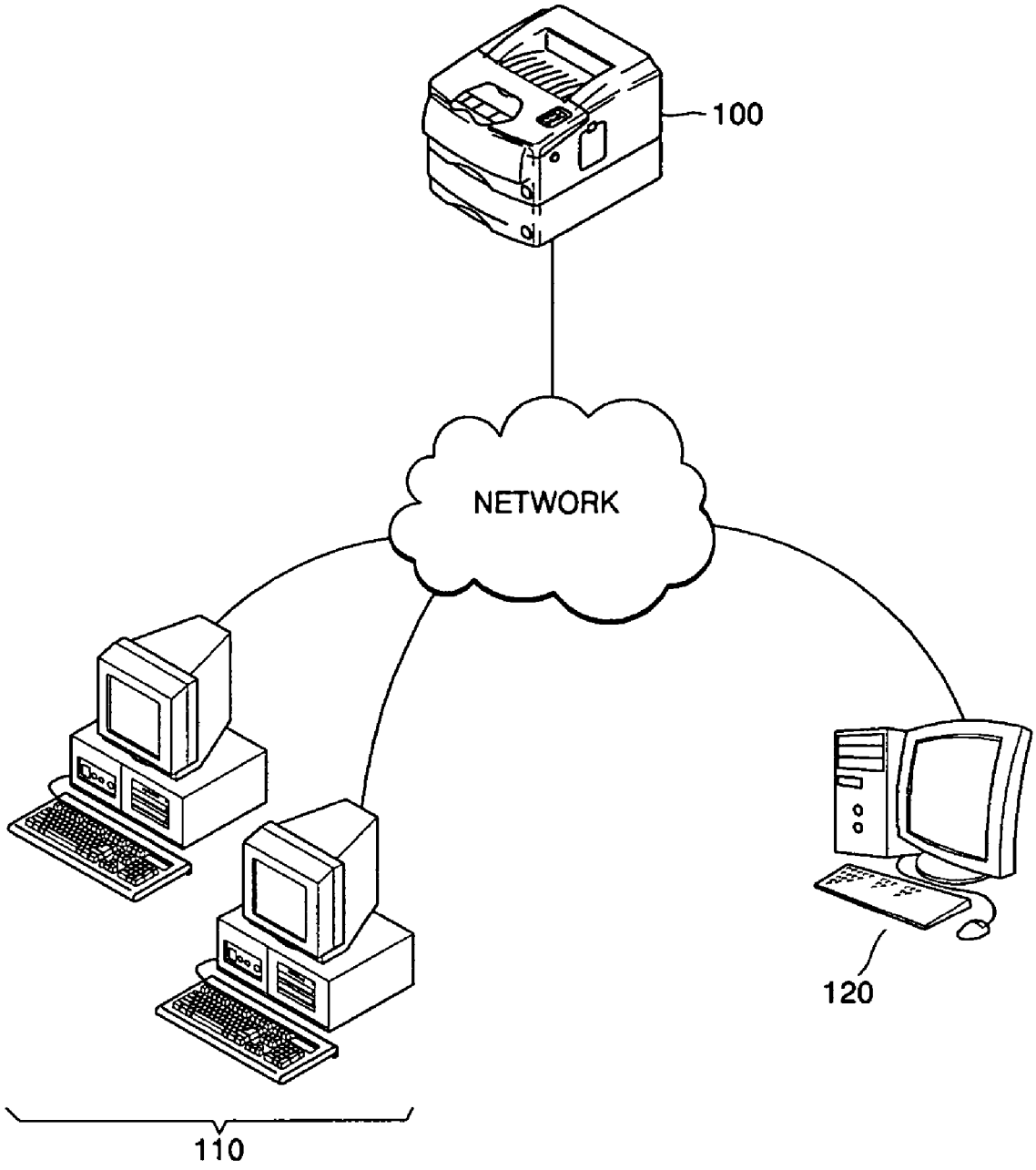
FIG. 1 is a diagram illustrating an image forming apparatus according to an exemplary embodiment of the present invention.

FIG. 1 is a diagram illustrating an image forming apparatus 100 according to an exemplary embodiment of the present invention. Referring to FIG. 1, the image forming apparatus 100 is connected to a plurality of host terminals 110 and 120. The host terminals 110 and 120 may be classified into a plurality of terminal groups according to a set of rules determined in advance. For example, the host terminal 110 may be classified into a user terminal group, and the host terminal 120 may be classified into a manager terminal group.

In the present embodiment, the image forming apparatus 100 may be a printer, and more particularly, a laser printer, though in other embodiments, the image forming apparatus 100 may be another device. If the image forming apparatus 100 is a laser printer, an expendable element installed therein may be a toner cartridge (not shown). The image forming apparatus 100 may be connected to more than one user terminal and to more than one manager terminal.

The image forming apparatus 100 uses an expendable element (not shown), which is replaceable, to form an image under the control of the host terminal 110 or 120. Specifically, the image forming apparatus 100 consumes an expendable material contained in the expendable element to form an image.

Figure 2:
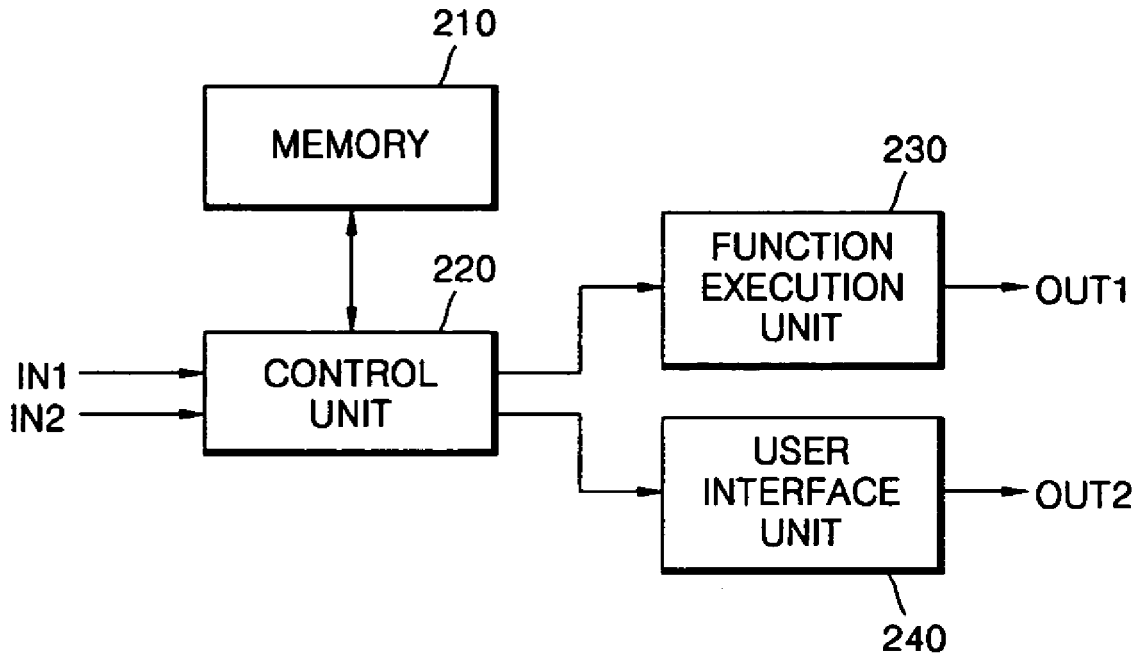
FIG. 2 is a block diagram of the image forming apparatus of FIG. 1.

In order to control the image forming apparatus 100 in such a manner, the expendable element may include a memory 210, as illustrated in FIG. 2. The memory 210 stores information indicating the state of the expendable element, and particularly, customer replacement unit monitor (CRUM) information.

The CRUM information may include identification information and a serial number of the expendable element, in which case, the image forming apparatus 100 can identify whether the expendable element was manufactured by the manufacturer of the image forming apparatus 100.

The CRUM information may include information regarding a remaining amount of expendable material contained in the expendable element. The information regarding the remaining amount of expendable material contained in the expendable element may include information regarding an accumulated number of times that the expandable element has been driven and the number of times that the expandable element can be driven. If the expendable element is a toner cartridge, the expendable material contained therein may be toner, and the number of times that the expendable element can be driven is related to the number of times required to use up toner contained in a new toner cartridge. In other words, the number of times that the expendable element can be driven may be the number of times that the expendable element can be driven until toner contained in a toner cartridge is used up. Information regarding the number of times that the expendable element can be driven is stored in the memory 210 before the new toner cartridge is used.

FIG. 2 is a block diagram of the image forming apparatus 100 of FIG. 1. Referring to FIGS. 1 and 2, the image forming apparatus 100 includes the memory 210, a control unit 220, a function execution unit 230, and a user interface unit 240. The expendable element of the image forming apparatus 100 may include the memory 210. A signal IN1 is transmitted by the host terminal 110, which may be a user terminal, or a signal IN2 is transmitted by the host terminal 120, which may be a manager terminal, to drive the image forming apparatus 100.

The memory 210 stores expendable material information for each of a plurality of terminal groups. The expendable material information is information indicating the amount of expendable material remaining in the expendable element after being used by the image forming apparatus 100. If the image forming apparatus 100 has not been driven since the expendable element was installed therein, the remaining amount of expendable material in the expendable element may be equal to the amount of expendable material initially contained in the expendable element.

The control unit 220 receives the signal IN1 or IN2 from the host terminal 110 or 120 and reads expendable material information corresponding to one of the terminal groups to which the host terminal 110 or 120 belongs from the memory 210. If the read expendable material information specifies the amount of expendable material required for forming an image, the control unit 220 generates a control signal. Here, the image may be an image of a letter or a picture.

The function execution unit 230 forms an image OUT1 by performing an operation in response to the control signal generated by the control unit 220. When the function execution unit 230 performs the operation, the expendable material information stored in the memory 210 is updated by the control unit 220.

The control unit 220 may generate the control signal only when a predetermined condition is met. In other words, if the CRUM information is expendable material information, the control unit 220 may generate the control signal only when the remaining amount of expendable material indicated by the read expendable material information is greater than or equal to the amount of expendable material that the image forming apparatus 100 is about to use.

However, if the remaining amount of expendable material indicated by the read expendable material information is less than the amount of expendable material that the image forming apparatus 100 is about to use, the control unit 220 controls the user interface unit 240 to display a message indicating such a shortage of expendable material. Referring to FIG. 2, a signal OUT2 indicates that the expendable element of the image forming apparatus 100 needs to be replaced with a new one.

Figure 3:
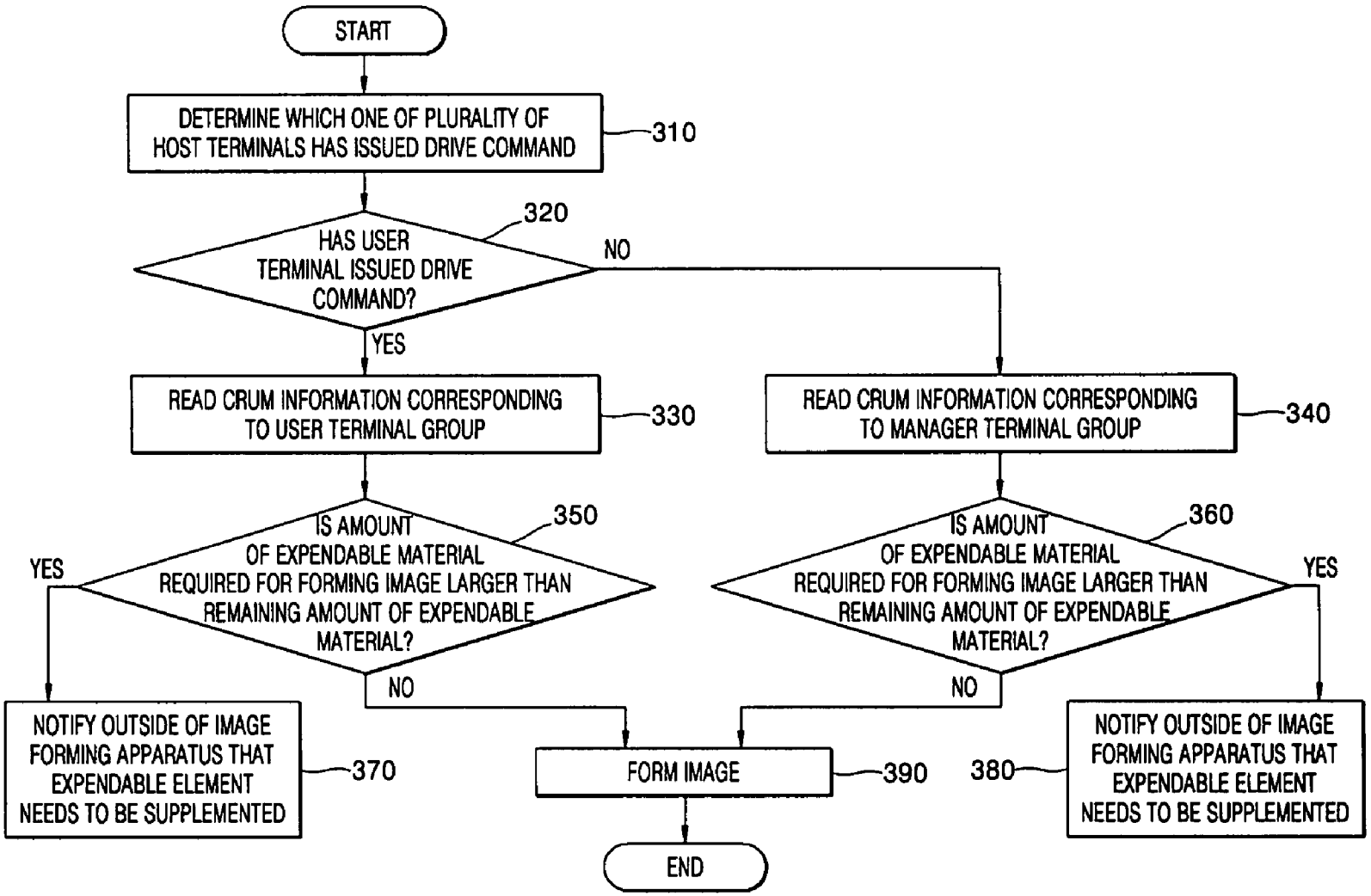
FIG. 3 is a flowchart illustrating an image forming method according to an exemplary embodiment of the present invention.

FIG. 3 is a flowchart illustrating an image forming method according to an exemplary embodiment of the present invention. Referring to FIG. 3, the method comprises determining to which terminal group a host terminal that has issued a command to drive an image forming apparatus belongs (steps 310 and 320), reading CRUM information corresponding to the determined terminal group (steps 330 and 340), and driving the image forming apparatus (steps 350 through 390).

In step 310, it is determined which of a plurality of host terminals has issued the drive command. In step 320, it is determined to which terminal group the host terminal that has issued the drive command belongs. For the convenience of explanation, which is by no means a limitation, it is assumed that the host terminals belong to either a user terminal group or a manager terminal group.

In step 330, if the host terminal that has issued the drive command belongs to the user terminal group, a control unit of the image forming apparatus reads CRUM information corresponding to the user terminal group from a user area of memory 210 of the image forming apparatus. Likewise, in step 340, if the host terminal that has issued the drive command belongs to the manager terminal group, the control unit reads CRUM information corresponding to the manager terminal group from a manager area of memory 210.

In step 350 or 360, if the CRUM information read in step 330 or 340 contains expendable material information, the control unit determines whether the amount of expendable material that the image forming apparatus is about to use is greater than a remaining amount of expendable material indicated by the read CRUM information. Specifically, if the control unit reads the CRUM information corresponding to the user terminal group from the user area of the memory in step 330, the method proceeds to step 350. On the other hand, if the control unit reads the CRUM information corresponding to the manager terminal group from the manager area of memory in step 340, the method proceeds to step 360. In other words, even though the host terminals shares the image forming apparatus, they use the image forming apparatus as if they were connected to a plurality of image forming apparatuses.

In step 370 or 380, if the amount of expendable material that the image forming apparatus is about to use is greater than or equal to the remaining amount of expendable material indicated by the read CRUM information in step 350 or 360, the control unit displays a message indicating such a shortage of expendable material.

In step 390, if the amount of expendable material that the image forming apparatus is about to use is less than the remaining amount of expendable material indicated by the read CRUM information in operation 350 or 360, the image forming apparatus forms an image under the control of the host computer that has issued the drive command.

An exemplary embodiment of the present invention can be realized as computer-readable code written on a computer-readable recording medium. The computer-readable recording medium may be any type of recording device in which data is stored in a computer-readable manner. Examples of the computer-readable recording medium include, but are not limited to, a ROM, a RAM, a CD-ROM, a magnetic tape, a floppy disc, an optical data storage, and a carrier wave (e.g., data transmission through the Internet). The computer-readable recording medium can be distributed over a plurality of computer systems connected to a network so that a computer-readable code is written thereto and executed therefrom in a decentralized manner. Functional programs, code, and code segments needed for realizing embodiments of the present invention can be easily deduced by one of ordinary skill in the art.

As described above, according to the exemplary embodiments of the present invention, a plurality of host terminals can share and use a single image forming apparatus and still obtain the benefits of being connected to a plurality of image forming apparatuses.

Therefore, in a network to which a plurality of host computers are connected, the single image forming apparatus can perform its normal operation for one terminal group while notifying another terminal group that there is the need to replace an expendable element.

While exemplary embodiments of the present invention have been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A printing device comprising:

a first terminal group comprising at least a first host terminal;

a second terminal group which is connected to the first terminal group via a network and comprises at least a second host terminal; and an image forming apparatus which is connected to the first and second terminal groups via the network, forms an image using an expendable material in response to a drive command issued by at least one of the first and second host terminals, divides an area of a memory into a plurality of areas, and stores information indicative of a remaining amount of the expendable material for each of the first and second terminal groups in each of the plurality of areas.

2. The printing device of claim 1, wherein the image forming apparatus comprises:

the memory which stores the information indicative of the remaining amount of the expendable material for each of the first and second terminal groups;

a control unit which reads, from the memory in response to the drive command, information corresponding to at least one of the first and second terminal groups to which the host terminal that has issued the drive command belongs, and generates a control signal if the read information specifies a required amount of the expendable material for forming an image; and a function execution unit which forms the image in response to the control signal, wherein, when the function execution unit forms the image, the information indicative of the remaining amount of expendable material stored in the memory is updated.

3. The printing device of claim 1, wherein the memory stores information indicative of an accumulated number of times that the image forming apparatus has been driven and a number of times that the image forming apparatus can be driven for each of the first and second terminal groups, and wherein the image forming apparatus is connected to the first and second terminal groups via the network and forms an image in response to the drive command.

4. The printing device of claim 2, wherein the memory stores information indicative of an accumulated number of times that the image forming apparatus has been driven and a number of times that the image forming apparatus can be driven for each of the first and second terminal groups, and wherein the control unit generates a control signal if the number of times that the image forming apparatus can be driven for at least one of the first and second terminal groups to which the host terminal that has issued the drive command belongs is greater than the accumulated number of times that the image forming apparatus has been driven, and wherein the accumulated number of times that the image forming apparatus has been driven is increased after the function execution unit forms the image.

5. An image forming apparatus which is connected to a network wherein at least one host terminals is connected the network, and which forms an image under the control of the at least one host terminals by consuming an expendable material, the image forming apparatus comprising:

a memory which comprises a plurality of areas and stores information indicative of a remaining amount of an expendable material for each of the host terminals in each of the plurality of areas;

a control unit which reads, from the memory in response to a drive command, information corresponding to at least one of the host terminals that has issued the drive command, and generates a control signal if the read information specifies a required amount of the expendable material for forming an image; and a function execution unit which forms the image in response to the control signal, wherein, when the function execution unit forms the image, the information indicative of the remaining amount of expendable material stored in the memory is updated.

6. The image forming apparatus of claim 5, wherein the host terminals are classified into a plurality of terminal groups, the memory stores the information indicative of the remaining amount of expendable material for each of the terminal groups, and the control unit reads information corresponding to the terminal group to which the host terminal that has issued the drive command belongs from the memory and generates a control signal if the read information specifies a required amount of the expendable for forming an image.

7. The image forming apparatus of claim 5, wherein the host terminals are classified into a first and second terminal groups, the memory stores information indicative of an accumulated number of times that the image forming apparatus has been driven and a number of times that the image forming apparatus can be driven for each of the first and second terminal groups, and the control unit generates a control signal if the number of times that the image forming apparatus can be driven for the terminal group to which the host terminal that has issued the drive command belongs is greater than the accumulated number of times that the image forming apparatus has been driven, and increases the accumulated number of times that the image forming apparatus has been driven after the function execution unit forms the image.

8. The image forming apparatus of claim 5, further comprising an expendable element installed in the image forming apparatus, wherein the expendable element comprises the memory, the memory being replaceable.

9. The image forming apparatus of claim 7, wherein the memory stores the information indicative of the number of times that the image forming apparatus can be driven before the image forming apparatus uses the expendable material for the first time.

10. The image forming apparatus of claim 5, wherein the image forming apparatus comprises a laser printer, and the expendable element comprises a toner cartridge.

11. An image forming method of driving an image forming apparatus in response to a drive command issued by one of a plurality of host terminals connected to a network to form an image using a predetermined expendable material, the image forming method comprising:

determining a host terminal of the plurality of host terminals which issued the drive command;

reading expendable material information, the information corresponding to the host terminal which issued the drive command, from stored expendable material information corresponding to the respective host terminals; and forming an image by driving the image forming apparatus in response to the drive command if the read expendable material information corresponding to the host terminal which issued the drive command indicates that a required amount of the expendable material for forming the image is less than a remaining amount of the expendable material associated with the host terminal which issued the drive command, wherein the expendable material information comprises information regarding the remaining amount of the expendable material.

12. The image forming method of claim 11, wherein the determining of the host terminal which issued the drive command comprises determining to which of the plurality of terminal groups the host terminal which issued the drive command belongs, and wherein the reading of the expendable material information comprises reading expendable material information corresponding to the terminal group to which the host terminal which issued the drive command belongs from stored expendable material information corresponding to the respective terminal groups.

13. The image forming method of claim 11 further comprising storing the expendable material information before the determining of the host terminal which issued the drive command.

14. The image forming method of claim 11 further comprising updating the expendable material information after forming the image.

15. The image forming method of claim 11 further comprising forming an image by driving the image forming apparatus in response to the drive command if the read expendable material information indicates that the required amount of expendable material is equal to the remaining amount of expendable material.

16. The image forming method of claim 11 further comprising displaying a message indicating that an expendable element of the image forming apparatus needs to be replaced if the required amount of expendable material is greater than the remaining amount of expendable material.

17. A computer-readable recording medium storing a computer program for executing an image forming method of driving an image forming apparatus in response to a drive command issued by at least one of a plurality of host terminals connected to a network to form an image using an expendable material, the image forming method comprising:

determining a host terminal of the plurality of host terminals which issued the drive command;

reading expendable material information, the information corresponding to the host terminal which issued the drive command from stored expendable material information corresponding to the respective host terminals; and forming an image by driving the image forming apparatus in response to the drive command if the read expendable material information corresponding to the host terminal which issued the drive command indicates that a required amount of the expendable material for forming the image is less than a remaining amount of the expendable material associated with the host terminal which issued the drive command, wherein the expendable material information comprises information regarding the remaining amount of the expendable material.

* * * * *